US007082771B2

(12) United States Patent
Jeppel et al.

(10) Patent No.: US 7,082,771 B2
(45) **Date of Patent: *Aug. 1, 2006**

(54) COMBUSTION CHAMBER

(75) Inventors: Paul-Heinz Jeppel, Waltrop (DE); Wilhelm Schulten, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 96 days.

This patent is subject to a terminal disclaimer.

(21) Appl. No.: 10/767,677

(22) Filed: Jan. 29, 2004

(65) Prior Publication Data

US 2004/0182085 A1 Sep. 23, 2004

(30) Foreign Application Priority Data

Jan. 29, 2003 (EP) ..... 03001890

(51) Int. Cl.
*F23R 3/50* (2006.01)

(52) U.S. Cl. ..... 60/798; 60/752; 60/755

(58) Field of Classification Search ..... 60/752, 60/754, 755, 756, 757, 758, 798, 800
See application file for complete search history.

(56) References Cited

U.S. PATENT DOCUMENTS 4,480,436 A * 11/1984 Maclin ..... 60/757
4,555,901 A * 12/1985 Wakeman et al. ..... 60/757
5,233,822 A * 8/1993 Ward et al. ..... 60/772
5,387,082 A * 2/1995 Matyscak ..... 415/209.2
7,007,489 B1 * 3/2006 Schulten ..... 60/796

FOREIGN PATENT DOCUMENTS

DE 41 14 768 A1 11/1991
DE 198 09 568 A1 8/1999

* cited by examiner

*Primary Examiner*—Ted Kim

(57) ABSTRACT

A combustion chamber (4) of a gas turbine (1), the combustion space (24) of which is bounded by an annular combustion chamber inner wall (28) and a combustion chamber outer wall (26), in which in order to generate a working medium (M) a supplied fuel is brought into reaction with supplied combustion air, and the combustion chamber wall (25) of which is provided on the inside with a lining formed from a plurality of heat shield elements (38), with the or each heat shield element (38) together with the combustion chamber wall (25) forming an inner space (40) to which a cooling medium (K) can be applied, is to be designed so as to provide a high level of system efficiency at the same time as having a comparatively simple structure and it should also be possible to disassemble the combustion chamber inner wall (28) in a time-saving manner. For this purpose according to the invention there is disposed in each case in the respective inner space (40) a cooling medium distributor (42) via which a cooling medium supply line (44) is connected to a plurality of cooling medium exit openings (46) and the combustion chamber inner wall (28) is formed from a plurality of wall elements (30) abutting each other at a horizontal parting joint (31), whereby the abutting wall elements (30) of the combustion chamber inner wall (28) are connected to one another at their horizontal parting joint (31) by means of a plurality of screw connections (32) oriented at an angle to the inner wall surface.

22 Claims, 5 Drawing Sheets

COMBUSTION CHAMBER

CROSS REFERENCE TO RELATED APPLICATIONS

This application claims priority of the European application No. 03001890.7 EP filed Jan. 29, 2003 under the European Patent Convention and which is incorporated by reference herein in its entirety.

FIELD OF INVENTION

The invention relates to a combustion chamber for a gas turbine, the combustion space of which is bounded by an annular outer wall on the one hand and an annular inner wall located within it on the other hand. The combustion chamber walls are provided on the inside with a lining formed from a plurality of heat shield elements, whereby the or each heat shield element forms an inner space to which a cooling medium can be applied. The invention further relates to a gas turbine having a combustion chamber of this kind.

BACKGROUND OF INVENTION

Combustion chambers form part of gas turbines, which are used in many fields to drive generators or machines. In such applications the energy content of a fuel is used to generate a rotational movement of a turbine shaft. For this purpose the fuel is combusted by burners in the combustion chambers connected downstream of them, with compressed air being supplied by an air compressor. Combustion of the fuel produces a high-temperature working medium which is subject to high pressure. This working medium is directed into a turbine unit connected downstream from the combustion chambers, where it expands in a manner that provides work output.

In this arrangement a separate combustion chamber can be assigned to each burner, whereby the working medium flowing out of the combustion chambers can be combined before or in the turbine unit. Alternatively the combustion chamber can however also be designed as what is known as an annular combustion chamber structure, in which a majority, in particular all, of the burners open out into a common, typically annular, combustion chamber. The turbine unit adjacent to the combustion chamber in the direction of flow of the working medium typically comprises a turbine shaft which is connected to a plurality of rotatable blades which form series of blades in an overlapping ring shape. The turbine unit also comprises a plurality of fixed vanes which are also attached in an overlapping ring shape to the inner housing of the turbine thereby forming series of vanes. The blades serve here to drive the turbine shaft by transmitting the pulse from the working medium flowing through the turbine unit, while the vanes serve to direct the flow of the working medium between two consecutive series of blades or blade rings viewed in the direction of flow of the working medium in each instance.

As the rotational movement of the turbine shaft is generally used to drive the air compressor connected upstream of the combustion chamber, this is extended beyond the turbine unit so that the turbine shaft is surrounded in a toroidal manner by the annular combustion space in the area of the annular combustion chamber connected upstream from the turbine. The combustion space is bounded in this case by an annular outer wall on the one hand and an annular inner wall located within it on the other hand. For this purpose the inner wall of the combustion chamber generally comprises two or more individual parts which are screwed together on their side facing the turbine shaft.

In the design of gas turbines of this kind a particularly high level of efficiency is one of the design aims in addition to the achievable performance. Here, an increase in efficiency can basically be achieved for thermodynamic reasons through an increase in the exit temperature at which the working medium flows out of the combustion chamber and into the turbine unit. For this reason temperatures of around 1200° C. to 1500° C. are aimed at for gas turbines of this kind and also attained.

With the working medium reaching such high temperatures, however, the components and parts exposed to this medium are subject to high thermal stresses. In order nonetheless to ensure a comparatively long useful life for the affected components, in particular the combustion chamber, while maintaining high reliability, it is usually necessary to construct them using particularly heat-resistant materials and to provide a means of cooling them. In order to prevent thermal deformations of the material which limit the useful life of the components, efforts are usually made to achieve as uniform a cooling of the components as possible.

For this purpose the combustion chamber wall can be lined on its inside with heat shield elements which can be provided with particularly heat-resistant protective layers and which are cooled through the actual combustion chamber wall. Toward that end, a cooling method also known as "impingement cooling" can be employed. With impingement cooling a cooling medium, generally cooling air, is supplied to the heat shield elements through a plurality of holes drilled in the combustion chamber wall so that the cooling medium impinges essentially vertically onto its external surface facing the combustion chamber wall. The cooling medium heated up by the cooling process is subsequently discharged from the inner space that the combustion chamber wall forms with the heat shield elements.

The manufacture of a cooling system of this type can be very expensive, however, since very many holes with a comparatively small cross-section are needed in the combustion chamber wall in order to achieve as uniform a cooling of the heat shields as possible, which can be very time- and cost-intensive. In particular the requirements to be met by the tools needed to produce the holes are very high, since the cooling air holes are relatively long compared to their cross-section because the structure of the combustion chamber wall must have a sufficiently great strength for stability reasons. Furthermore, with a large number of cooling air holes which in total add up to a large surface area, there is a possibility of friction and turbulence occurring in the supply of the cooling medium. This leads to an increased cooling medium pressure loss in the cooling medium circuit, which has a disadvantageous effect on the efficiency of the combustion chamber.

Moreover the design of the annular combustion chamber described above has a number of further disadvantages with regard to necessary maintenance work. With these maintenance and repair activities, which are generally performed at regular intervals, it is necessary to repair or replace parts of the combustion chamber such as, for example, the heat shield elements or the cooling system used as well as in particular also components of the downstream turbine unit because of the high thermal and mechanical loads to which they are exposed. A disadvantage in the design of the combustion chamber is that the turbine shaft is not accessible from the combustion chamber when maintenance work is carried out. Consequently, in order to perform maintenance work on the turbine shaft in the area of the annular combustion chamber or to carry out repairs to the first vanes and blades immediately adjacent to the combustion chamber, it is usually necessary to remove all the contiguous vanes and blades of the turbine unit. Only after all vanes and blades of the turbine have been disassembled is it possible to remove the inner wall of the combustion chamber by way of the screw connection facing the turbine shaft and so gain access to the turbine shaft. The assembly work is therefore very labor- and time-intensive. As a result of the comparatively long operational outage of the gas turbine, downtime costs are incurred in addition to the assembly costs for the gas turbine, leading to comparatively very high total costs for maintenance and repair work to the gas turbine.

SUMMARY OF INVENTION

The object of the invention is therefore to specify a combustion chamber of the aforementioned type which, while being of comparatively simple construction, is suited to a particularly high system efficiency and in which the inner wall of the combustion chamber is comparatively quick and easy to dismantle.

A gas turbine with the aforementioned combustion chamber is also to be specified.

With regard to the combustion chamber, the object is achieved according to the invention in that a plurality of cooling medium distributors is disposed in each case in the inner space assigned to the respective heat shield element, and in that the inner wall of the combustion chamber is formed from a plurality of wall elements fixed on a support structure of the inner wall, whereby the support structure is formed from a plurality of sub-components abutting each other at a horizontal parting joint which are connected to each other in the area of the parting joint by means of a plurality of screw connections oriented at an angle to the inner wall surface.

The invention is based on the consideration that in order to achieve a particularly high level of efficiency a reliable and in particular comprehensive application of cooling medium to entire surface area of the heat shield elements should be ensured. Even if this requirement is consistently complied with, the overhead in terms of equipment and in particular the manufacturing overhead are kept low by replacement of the plurality of cooling medium holes provided hitherto by a simplified system. At the same time, in order to maintain the cooling effect at the same high level on the one hand and to simplify the supply on the other hand, a subdivision of the cooling medium flow path into individual sub-paths is provided only as closely as possible to the heat shield element to be cooled, in other words particularly far at the end of the flow path. These functions are fulfilled by the cooling medium distributors. With regard to the maintenance work, the invention is based on the consideration that the fixing connecting the various wall elements of the inner wall of the combustion chamber to one another should be accessible from the combustion space and so it should also be possible to dismantle the combustion chamber inner wall from here too. At the same time the different elements of the support structure of the combustion chamber inner wall which abut each other at their horizontal parting joint should be connected to each other by means of a fixing which connects these to each other at the parting joint by a vertical force. These two functions are provided by the screw connections oriented at an angle to the inner wall surface which are accessible from the combustion chamber and also provide a sufficiently large vertical force component to secure two support structure elements abutting each other at the horizontal parting joint.

In order to compensate for the horizontal force component of two support structure elements resulting from the screw connection oriented at an angle to the inner wall, said support structure elements being connected to each other by the screw connection, a feather key is expediently assigned to each screw connection. The feather key prevents the support structure elements screwed to each other at the horizontal parting joint from being shifted toward each other by the horizontal force component of the screw connection. For this purpose the feather key advantageously runs along the horizontal parting joint and fits precisely in each case into grooves in the abutting support structure elements, so that these cannot move toward each other and preferably only the vertical force component of the screw connection required for securing the screw connection occurs at the horizontal parting joint.

A cooling medium supply line is expediently connected in each case to a plurality of cooling medium exit openings via a cooling medium distributor. By this means the heat shields located immediately in front of the cooling medium distributors can be cooled by impingement cooling.

In order to increase the effect of the impingement cooling when the cooling medium distributors are used, the exit openings of the cooling medium distributor are expediently dimensioned such that the sum of the cross-sectional areas of all the exit openings is less than the cross-section of the cooling medium supply line. This reduction in cross-section in the direction of flow of the cooling medium advantageously produces a venturi effect through which the exit speed of the cooling medium is increased at the exit openings and as a result the effect of the impingement cooling at the heat shield elements is also improved.

The cooling medium heated up after the cooling process is expediently drained off from the inner space between the heat shields and the combustion chamber wall through holes in the combustion chamber wall into a cooling medium discharge system. Owing to the shape and a suitable arrangement of the cooling medium distributors which ensures a sufficient distance of the cooling medium distributors from one another, the heated cooling air can flow through the spaces between the cooling medium distributors to the openings of the holes located on the wall of the combustion chamber. In order to ensure uniform cooling of the combustion chamber the recirculation holes are distributed preferably evenly over the entire length of the combustion chamber in the same ratio to the number of cooling medium distributors so that the cooling medium can be drained off uniformly at an approximately equal recirculation temperature in all the recirculation holes.

In order to position the heat shields to cover the entire surface of the inner wall over the cooling medium distributors located at the wall, the recirculation holes and the parting joint screw connections, these are expediently secured to the inner wall of the combustion chamber by means of a tongue and groove system. In this arrangement heat shield elements are preferably shaped at their edges such that they form a double bend toward the combustion chamber to create an anchorage and anchor themselves in a recess in the combustion chamber wall which forms the groove, thereby being secured. The recess in the combustion chamber wall is expediently combined to serve adjacent heat shield elements, so that adjacent heat shield elements abut each other at their front face resulting from the bend, thereby forming a seal for the combustion chamber and the working medium flowing therein.

The combustion chamber referred to above is preferably part of a gas turbine.

The advantages achieved with the invention consist in particular in that the use of cooling medium distributors enables large-area and comprehensive application of cooling medium to the heat shield elements even with only a small manufacturing overhead. In addition, the cooling medium pressure loss can be kept low during the cooling of the combustion chamber, thus resulting in an increase in the system efficiency of the combustion chamber. The low cooling medium pressure loss can also be achieved in particular because the cooling air distributors require only a small number of supply holes in the combustion chamber wall. The use of a plurality of cooling medium distributors can ensure uniform cooling with little cooling medium pressure loss, since in the cooling medium supply via a cooling medium distributor the cooling medium branches from a relatively large cooling medium supply line into a plurality of smaller cooling medium exit openings only shortly before the impingement cooling at the heat shield elements. This ensures that the cooling medium only flows through a short section with a relatively small cross-section, with the result that the cooling medium pressure loss is limited.

The parting joint screw connection arrangement of the combustion chamber walls permits a comparatively easy and quick assembly of the combustion chamber walls. In particular the possibility of removing the inner wall of the combustion chamber allows fast access to the turbine shaft and to the blades and vanes of the turbine unit which are immediately adjacent to the combustion chamber for the purpose of maintenance and repair work. Time-consuming removal of the blades and vanes contained within the further course of the turbine unit is therefore not necessary since access is possible from the inside of the combustion chamber, so maintenance work can be carried out comparatively easily and quickly.

Because the heat shield elements are secured by means of a tongue and groove system there is not only adequate sealing of the inside of the combustion chamber inner space but at the same time also sufficient room for the cooling system located below the heat shields as well as for the parting joint screw connection.

The combustion chamber referred to above is preferably part of a gas turbine.

BRIEF DESCRIPTION OF THE DRAWINGS

An exemplary embodiment is described in more detail with reference to a drawing, in which.

DETAILED DESCRIPTION OF INVENTION

Figure 1:
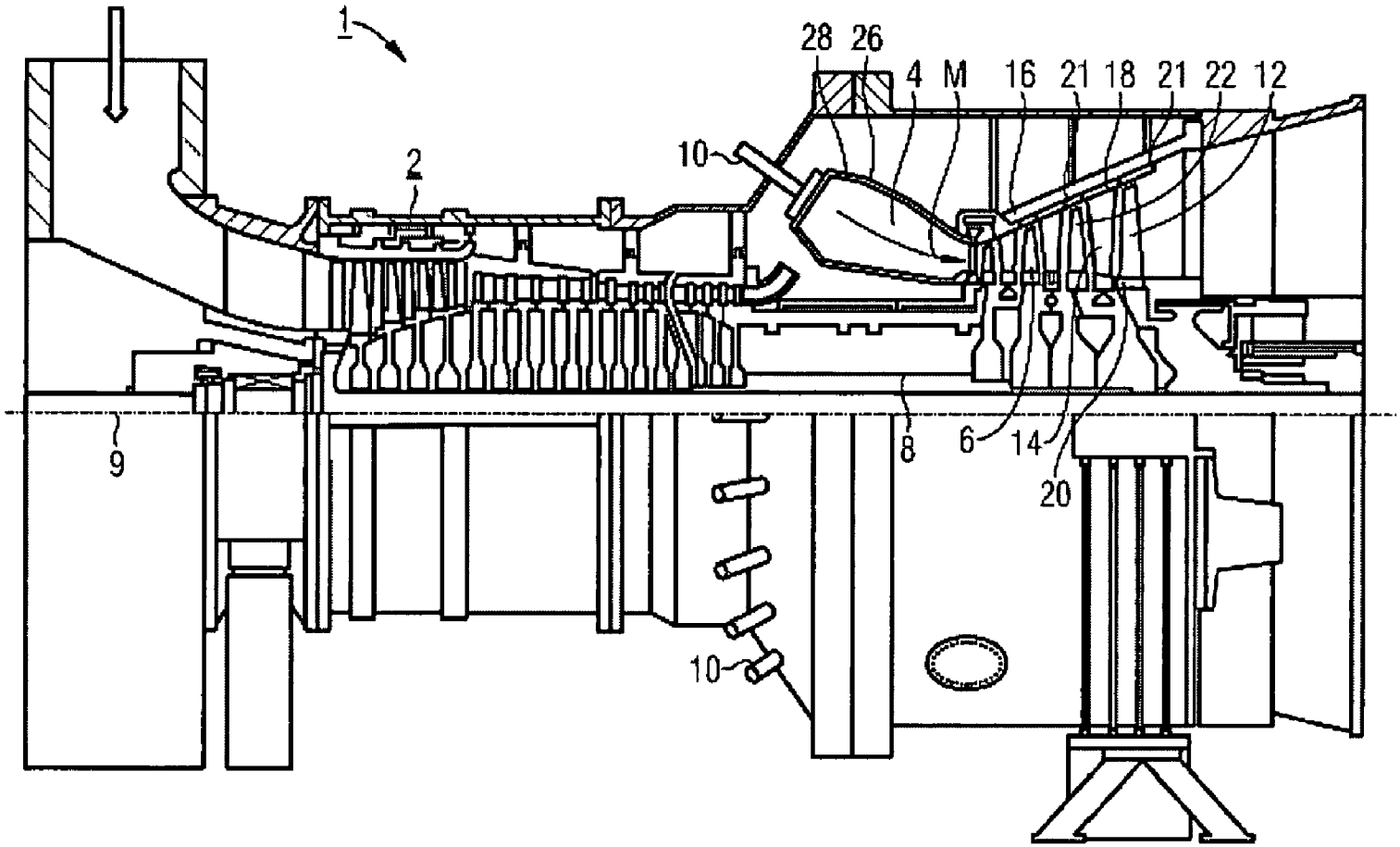
FIG. 1 shows a half-section through a gas turbine.

The gas turbine 1 according to FIG. 1 has a compressor 2 for combustion air, a combustion chamber 4 and a turbine 6 to drive the compressor 2 and a generator or machine (not shown). The turbine 6 and the compressor 2 are also arranged on a common turbine shaft 8, also referred to as the turbine rotor, to which the generator or machine is also connected and which is mounted so that it can be rotated about its central axis 9. The combustion chamber 4 implemented in the form of an annular combustion chamber is fitted with a plurality of burners 10 for combusting a liquid or gaseous fuel.

The turbine 6 has a plurality of rotatable blades 12 connected to the turbine shaft 8. The blades 12 are arranged in an overlapping ring shape on the turbine shaft 8, thereby forming a plurality of series of blades. The turbine 6 also has a plurality of fixed vanes 14 which are also attached in an overlapping ring shape on an inner housing 16 of the turbine 6 to form series of vanes. The blades 12 serve here to drive the turbine shaft 8 by pulse transmission from the working medium M flowing through the turbine 6. The vanes 14 on the other hand serve to direct the flow of the working medium M between two consecutive series of blades or blade rings viewed in the direction of flow of the working medium M in each case. A consecutive pair from a ring of vanes 14 or a series of vanes and a ring of blades 12 or a series of blades is in this case also referred to as a turbine stage.

Each vane 14 has a platform 18, also referred to as a vane root, which is arranged as a wall element on the inner housing 16 of the turbine 6 to fix the respective vane 14. In this case the platform 18 is a component which is subject to a comparatively high level of thermal loading and which forms the outer boundary of a fuel gas channel for the working medium M flowing through the turbine 6. Each blade 12 is similarly secured to the turbine shaft 8 via a platform 20, also referred to as a blade root.

A guide ring 21 is arranged on the inner housing 16 of the turbine 6 between each of the separated platforms 18 of the vanes 14 of two adjacent series of vanes. The outer surface of each guide ring 21 is thereby also exposed to the hot working medium M flowing through the turbine 6 and separated from the outer end 22 of the opposite blade 12 by a gap in the radial direction. The guide rings 21 arranged between adjacent series of vanes are hereby used in particular as cover elements which protect the inner wall 16 or other integral housing parts from thermal overload by the hot working medium M flowing through the turbine 6.

In the exemplary embodiment the combustion chamber 4 is designed as what is known as an annular combustion chamber, wherein a plurality of burners 10 arranged in the circumferential direction around the turbine shaft 8 open out into a common combustion chamber space. The combustion chamber 4 is also implemented in its entirety as an annular structure which is positioned around the turbine shaft 8.

Figure 2:
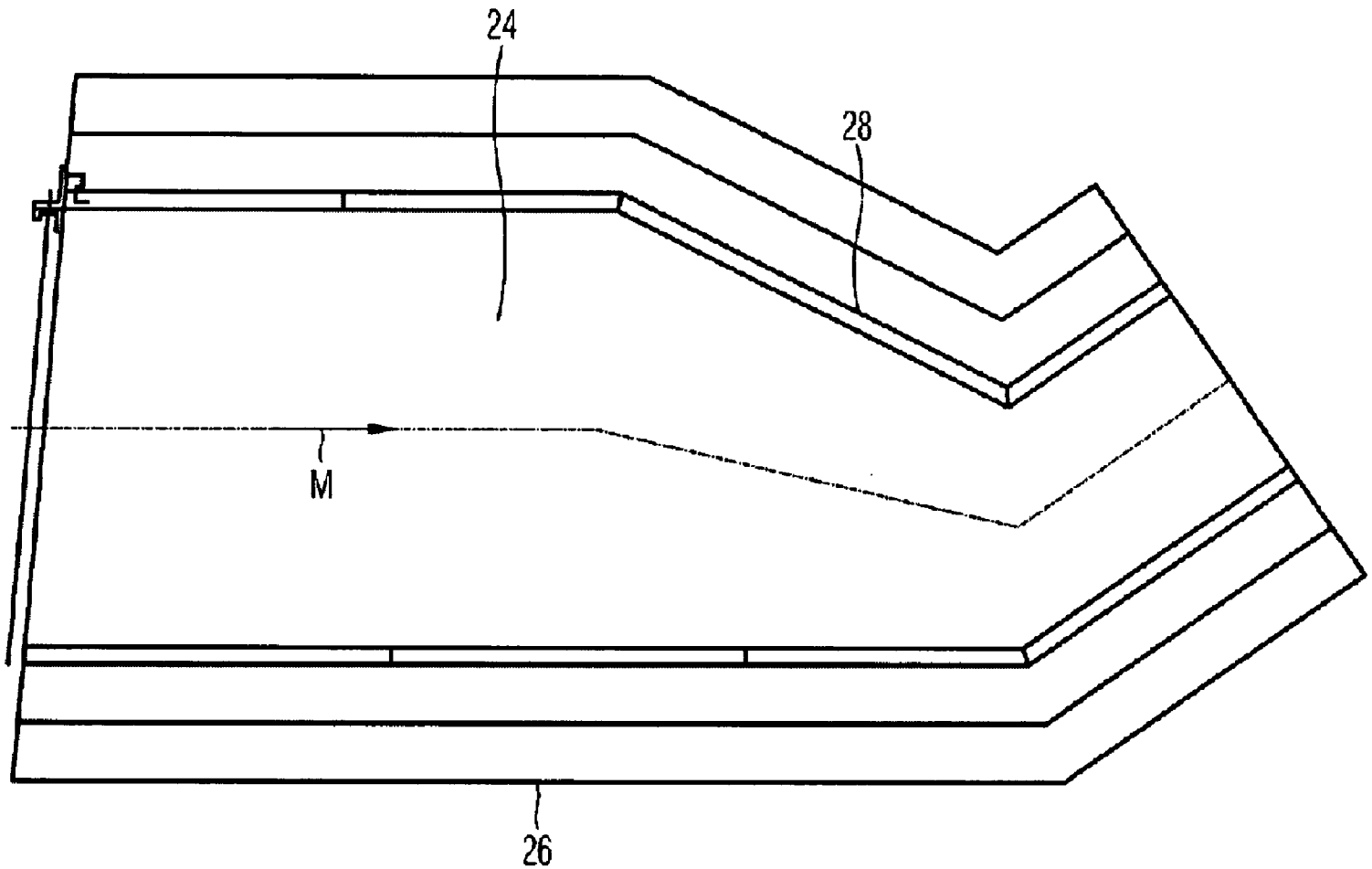
FIG. 2 shows a section through a combustion chamber.

To further clarify the embodiment of the combustion chamber 4, FIG. 2 shows the combustion chamber 4 in cross-section as it continues in a toroidal manner around the turbine shaft 8. As shown in the diagram, the combustion chamber 4 has an initial or inflow section into which the end of the outlet of the respective assigned burner 10 opens. Viewed in the direction of flow of the working medium M, the cross-section of the combustion chamber 4 then narrows, with account being taken of the resulting flow profile of the working medium M in this area. On the outlet side, the combustion chamber 4 exhibits in its longitudinal cross-section a curve which favors the outward flow of the working medium M from the combustion chamber 4 resulting in a particularly high pulse and energy transmission to the following first series of blades seen from the flow side.

Figure 3:
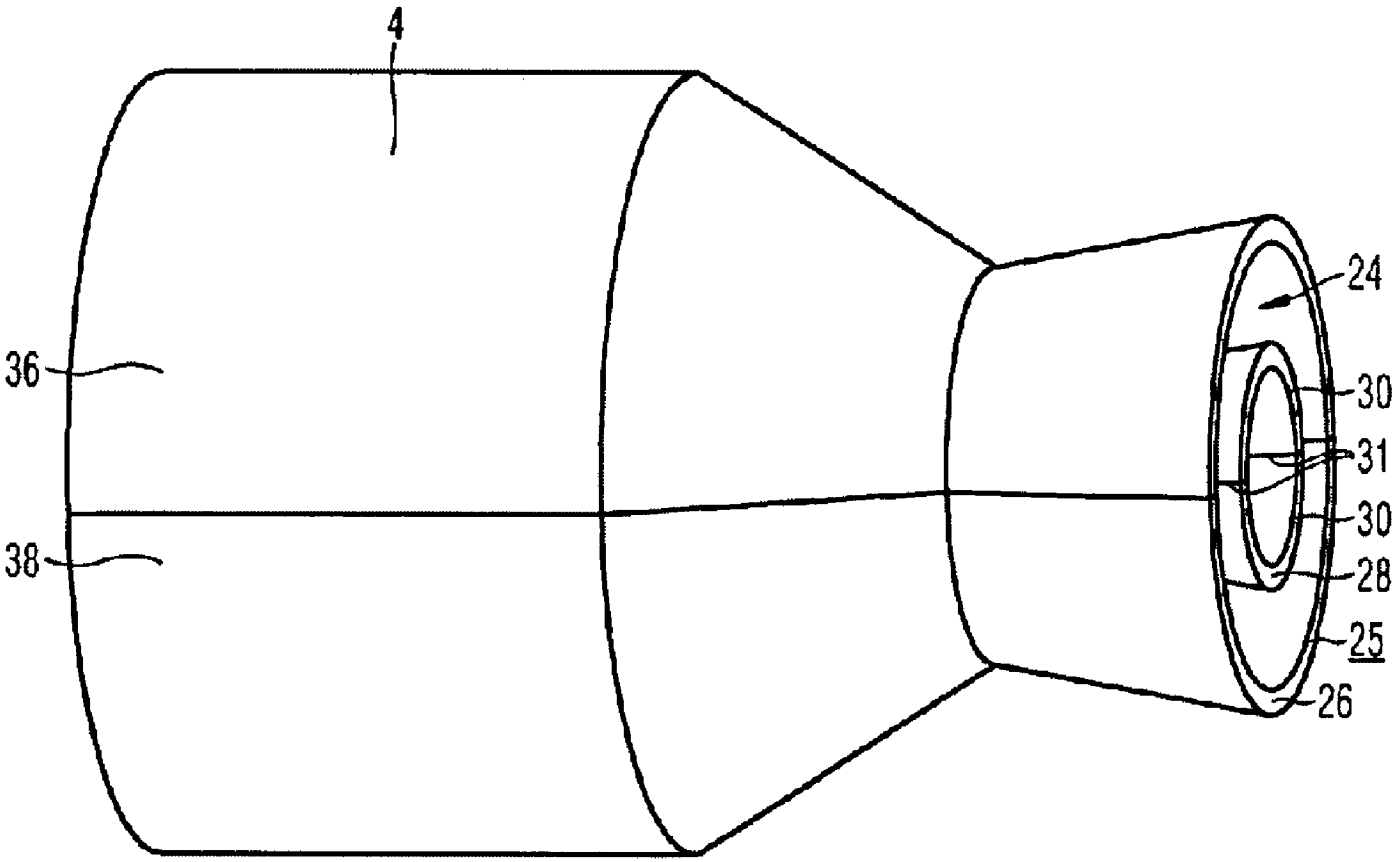
FIG. 3 shows a side view of the annular combustion chamber.

As shown in the diagram according to FIG. 3, the combustion space 24 of the combustion chamber 4 is bounded by a combustion chamber wall 25 which is formed by an annular combustion chamber outer wall 26 on the one hand and by an annular combustion chamber inner wall 28 located therein on the other hand. The combustion chamber 4 is designed so that the combustion chamber inner wall 28 can be removed particularly easily, for maintenance work for example, in order to gain access to the turbine shaft 8 surrounded by the combustion chamber inner wall 28 and the blades 12 and vanes 14 of the turbine 6 which are directly adjacent to the combustion chamber 4. The combustion chamber inner wall 28 also comprises two wall elements 30 which are joined together with the combustion chamber inner wall 28 to form an essentially horizontal parting joint 31.

Figure 4:
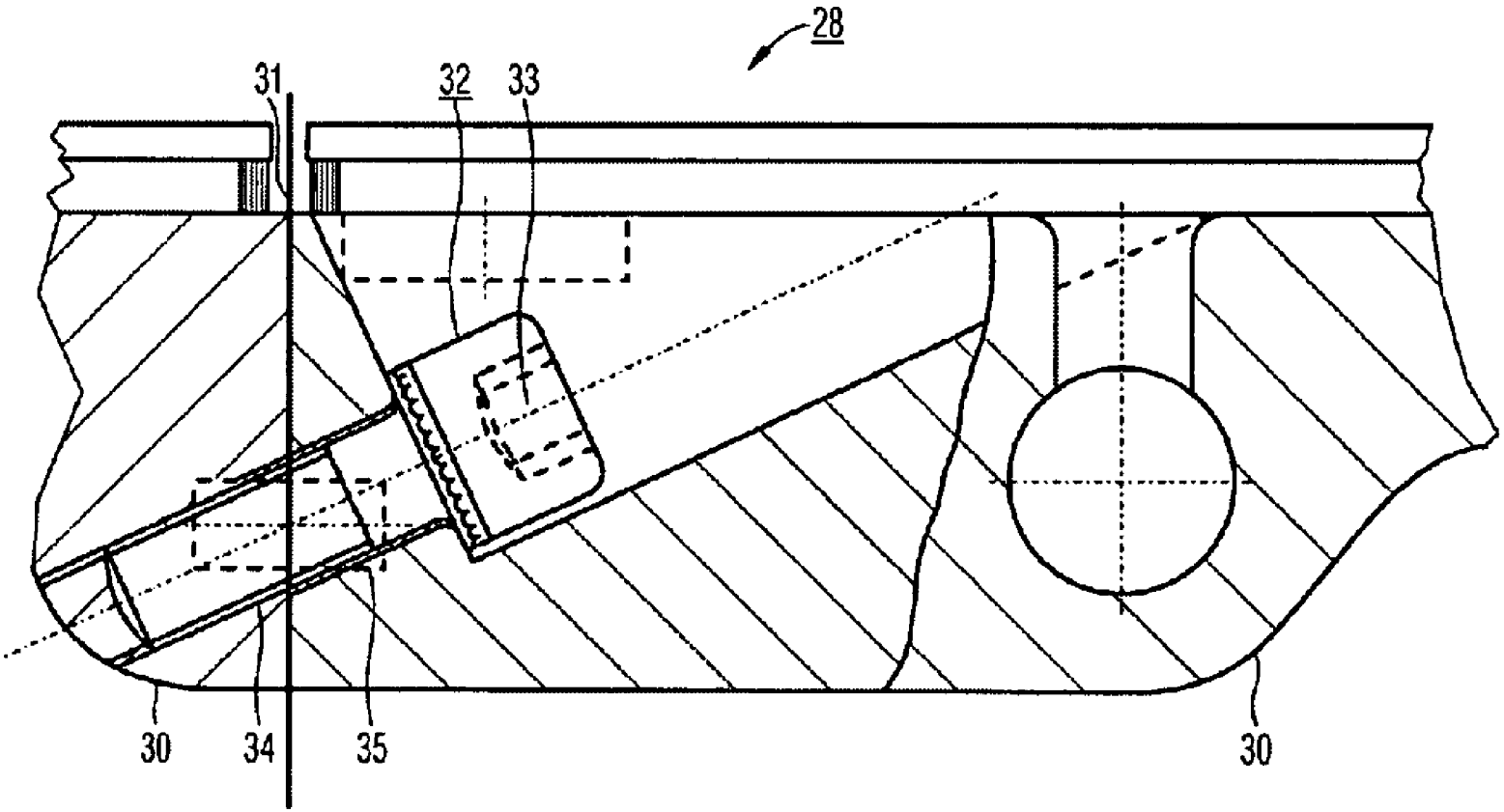
FIG. 4 shows a sectional view of a screw connection of the wall elements of the combustion chamber inner wall.

The combustion chamber 4 is designed in particular so that the wall elements 30 of the combustion chamber inner wall 28 can be dismantled from the combustion space 24. As shown in cross-section in FIG. 4, the wall elements 30 are connected for this purpose at the horizontal parting joint 31 formed by them by means of screw connections 32 oriented at an angle to the inner surface of the combustion chamber inner wall 28. Here, each screw connection 32 comprises a screw 33 essentially directed at an angle to the surface formed by the combustion chamber inner wall 28, said screw interacting with a thread 34 incorporated in one of the wall elements 30.

So that the wall elements 30 do not move toward each other due to the horizontal force component resulting from the screws 33 running at an angle to the combustion chamber inner wall 28, a feather key 35 is assigned to the screw connection 32. This is located in a position close to the respective screw connection 32 along the horizontal parting joint 31 of the wall elements 30 and fits into grooves in the wall elements 30 of the combustion chamber inner wall 28.

Figure 5:
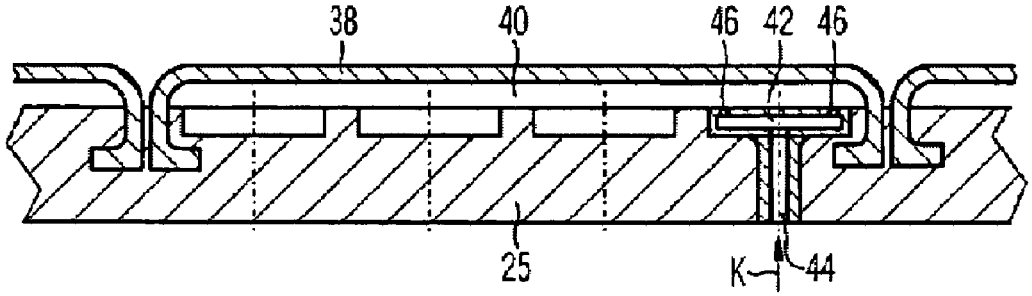
FIG. 5 shows a sectional view of a section of the combustion chamber wall.

To achieve a comparatively high level of efficiency, the combustion chamber 4 is designed for a comparatively high temperature of the working medium M of around 1200° C. to 1500° C. In order to achieve a comparatively long operating life even with these unfavorable operating parameters for the materials, the combustion chamber wall 25 as shown in FIG. 5 is provided with a lining made from heat shield elements 38 on its side facing the working medium M. Each heat shield element 38 is provided with a particularly heat-resistant protective layer on the side facing the working medium M. On account of the high temperatures in the interior of the combustion chamber 4 a cooling system is additionally provided for the heat shield elements 38. In this case the cooling system is based on the principle of impingement cooling, where cooling air K as the cooling medium is blasted under sufficiently high pressure at a plurality of points against the component to be cooled.

The cooling system is designed with a simple structure to provide a reliable, comprehensive application of cooling air to the entire area of the heat shield elements 38 and in addition to ensure a particularly low cooling medium pressure loss. Toward that end, the heat shield elements 38 are cooled from their outer face by the cooling air K which is directed onto the surface of the respective heat shield element 38 through a plurality of cooling medium distributors 42 disposed in the inner space 40 formed by the respective heat shield element 38 and the combustion chamber wall 25.

To further clarify the embodiment of the cooling arrangement for the heat shield elements 38, FIG. 5 shows a section of the combustion chamber wall 25 in cross-section. As can be seen in this view, a plurality of cooling medium distributors 42 are distributed over the entire area of the respective heat shield element 38 in order to ensure uniform cooling. In this arrangement the cooling medium K flows through an assigned. cooling medium supply line 44 into the respective cooling medium distributor 42. Through this the cooling medium K is routed through a plurality of cooling medium exit openings 46 onto the surface of the heat shield element 38 where the latter is cooled by the cooling medium K by means of impingement cooling. The holes for the cooling medium supply lines 44 are to be incorporated in a simple and time-saving way during the manufacture of the combustion chamber 4, since only one cooling medium supply line 44 is required in each case for each cooling medium distributor 42.

As can further be seen in the view shown in FIG. 5, the cooling medium exit openings 46 of the cooling medium distributor 42 have a smaller cross-section in total than the cooling medium supply line 44 of the cooling medium distributor 42. As the cooling medium K flows through the cooling medium distributor 42 this leads to a venturi effect and associated with this to an increased exit speed of the cooling medium K at the cooling medium exit openings 46, as a result of which the effect of the impingement cooling at the heat shield elements 38 is intensified.

As shown by way of example for the combustion chamber wall 25 in FIG. 5, the heat shield elements 38 are secured to the combustion chamber wall 28 in a space-saving manner for the attached cooling system as well as the parting joint screw connection. For this purpose a tongue and groove system is used. In this arrangement the edges of the heat shield elements 38 are shaped such that they have a double bend toward the combustion chamber so as to form an anchorage and they anchor themselves in a recess in the combustion chamber inner wall 25 which forms the groove, thereby becoming secured. As can also be seen in FIG. 5, adjacent heat shield elements 38 are secured to combined grooves in such a way that they are in reciprocal contact and thus seal the combustion space 24 of the combustion chamber 4.

The invention claimed is:

1. A combustion chamber for a gas turbine, comprising:

a combustion chamber inner wall and a combustion chamber outer wall, defining an annular combustion space between the inner wall and the outer wall;

a first lining formed from a plurality of heat shield elements arranged on an interior of the outer wall defining a first inner space between the heat shield element and the outer wall;

a second lining formed from a plurality of heat shield elements arranged on an exterior of the inner wall defining a second inner space between the heat shield element and the inner wall; and a cooling medium adapted to flow within the first inner space and second inner space, wherein the inner wall comprises a plurality of wall elements abutting each other at a horizontal parting joint, the wall elements connected to each other in the area of the parting joint by a plurality of screw connections oriented at a non-perpendicular angle to an inner wall surface and the horizontal parting joint.

2. The combustion chamber according to claim 1, wherein a feather key is assigned to a corresponding screw connection.

3. The combustion chamber according to claim 1, wherein a cooling medium supply line is connected to a plurality of cooling medium exit openings via a cooling medium distributor.

4. The combustion chamber according to claim 3, wherein the cooling medium exit openings are dimensioned such that the sum total of the cross-sectional areas of all the cooling medium exit openings of a cooling medium distributor is less than the cross-sectional area of the assigned cooling medium supply line.

5. The combustion chamber according to claim 4, wherein the first inner space is connected to a cooling medium discharge system via a plurality of holes.

6. The combustion chamber according to claim 5, wherein the combustion chamber is used in a gas turbine.

7. The combustion chamber according to claim 4, wherein the second inner space is connected to a cooling medium discharge system via a plurality of holes.

8. The combustion chamber according to claim 1, wherein the heat shield elements are fixed to the combustion chamber inner wall or to the combustion chamber outer wall via a tongue and groove system.

9. The combustion chamber according to claim 1, wherein the angle is between 20 degrees and 70 degrees.

10. A combustion chamber for a gas turbine, comprising:

an outer wall having an inner side and an outer side, and a first portion and a second portion;

an inner wall having an inner side and an outer side, and a first portion and a second portion;

a first temperature resistant liner attached to the outer side of the first portion of the inner wall and positioned on the inner side of the first portion of the outer wall;

a second temperature resistant liner attached to the outer side of the second portion of the inner wall and positioned on the inner side of the second portion of the outer wall; and a plurality of fasteners adapted to removably connect the first and second portions of the inner wall, wherein the inner wall comprises a plurality of wall elements abutting each other at a horizontal parting joint with the plurality of fasteners oriented at a non-perpendicular angle to an inner wall surface and the horizontal parting joint.

11. The combustion chamber as claimed in claim 10, wherein the first portion of the outer wall is an upper half.

12. The combustion chamber as claimed in claim 10, wherein the second portion of the outer wall is a lower half.

13. The combustion chamber as claimed in claim 10, wherein the inner side of the outer wall and the outer side of the inner wall define a combustion zone for combusting a combustible fuel.

14. The combustion chamber as claimed in claim 10, wherein the liner is formed from a plurality of heat shield elements.

15. The combustion chamber as claimed in claim 14, wherein the heat shield elements are fixed to the inner wall of the outer portion and to the outer portion of the inner wall via a tongue and groove system.

16. The combustion chamber as claimed in claim 10, wherein the fasteners are inter-engaging elements.

17. The combustion chamber as claimed in claim 16, wherein the inter-engaging elements are oriented at an angle relative to the outer surface of the inner wall.

18. The combustion chamber as claimed in claim 10, wherein the fasteners are screws.

19. The combustion chamber as claimed in claim 10, wherein a feather key is assigned to a corresponding fastener.

20. The combustion chamber as claimed in claim 10, wherein a first inner space is defined by a heat shield and the inner surface of the outer wall, and a second inner space is defined by the heat shield and the outer surface of the inner wall.

21. The combustion chamber as claimed in claim 20, wherein a cooling medium is adapted to flow within the first inner space and second inner space.

22. The combustion chamber as claimed in claim 10, wherein the angle is between 20 degrees and 70 degrees.

* * * * *